US010906720B2

(12) United States Patent
Ji

(10) Patent No.: US 10,906,720 B2
(45) Date of Patent: Feb. 2, 2021

(54) TWO MEMBER CUSHION

(71) Applicant: PEGATRON CORPORATION, Taipei (TW)

(72) Inventor: Shan-Jie Ji, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 115 days.

(21) Appl. No.: 16/249,993

(22) Filed: Jan. 17, 2019

(65) Prior Publication Data

US 2019/0256274 A1 Aug. 22, 2019

(30) Foreign Application Priority Data

Feb. 21, 2018 (TW) ..... 107105828 A

(51) Int. Cl.
*B65D 81/127* (2006.01)
*B65D 81/02* (2006.01)

(52) U.S. Cl.
CPC ..... *B65D 81/127* (2013.01); *B65D 81/022* (2013.01)

(58) Field of Classification Search
CPC .... B65D 81/02; B65D 81/022; B65D 81/107; B65D 81/127
USPC ..... 206/521, 523
See application file for complete search history.

(56) References Cited

U.S. PATENT DOCUMENTS

| | | | | |
|---|---|---|---|---|
| 3,334,798 | A * | 8/1967 | Pezely, Jr. | B65D 81/107 206/523 |
| 7,114,618 | B2 * | 10/2006 | Arnold | B65D 81/107 206/523 |
| 7,654,391 | B2 * | 2/2010 | Langer | B65D 81/056 206/523 |
| 8,752,707 | B2 * | 6/2014 | McDonald | B65D 81/057 206/592 |
| 2007/0164540 | A1 | 7/2007 | Van Dijk | |
| 2008/0289988 | A1 | 11/2008 | Sorensen | |
| 2016/0159549 | A1 | 6/2016 | Yeh et al. | |

FOREIGN PATENT DOCUMENTS

| | | | |
|---|---|---|---|
| CN | 1819952 | A | 8/2006 |
| CN | 105668003 | A | 6/2016 |
| TW | M502019 | U | 6/2015 |

* cited by examiner

*Primary Examiner* — Bryon P Gehman
(74) *Attorney, Agent, or Firm* — McClure, Qualey & Rodack, LLP

(57) ABSTRACT

A cushion includes a first member and a second member. The first member includes a first body and at least one first extending portion. At least one sidewall of the first extending portion has a first protruding portion. The second member includes a second body and a plurality of second extending portions. At least one sidewall of each second extending portion has at least one second protruding portion corresponding to the first protruding portion. When the first member and the second member are assembled, the first extending portion and the second extending portions are staggered with each other. When the first member and the second member move away from each other by a predetermined distance, the first protruding portion is clamped to the second protruding portion.

11 Claims, 8 Drawing Sheets

30

TWO MEMBER CUSHION

CROSS-REFERENCE TO RELATED APPLICATION

This non-provisional application claims priority under 35 U.S.C. § 119(a) to Patent Application No. 107105828 filed in Taiwan, R.O.C. on Feb. 21, 2018, the entire contents of which are hereby incorporated by reference.

BACKGROUND

Technical Field

The application relates to a cushion.

Related Art

Products made of foamed materials have advantages such as a light weight, shock absorption, and cushioning, and are therefore widely applied to cushioning apparatuses. A conventional cushion is made of a foamed material and has a flat panel shape. During use, a cushion may be properly cut by a person according to the size of a carried object. An increasingly large number of manufacturers provide cushions for existing products during packaging in the production of the products. Based on the widths or lengths of products, manufacturers usually make different cushions having corresponding widths or lengths. However, this approach causes a waste of materials and increased costs, and in addition, it is difficult to store such cushions.

SUMMARY

An aspect of the application is to provide a cushion. The cushion can reduce material usage to reduce costs and enhance environmental protection awareness in answer to energy conservation and carbon emission reduction.

The cushion includes a first member and a second member. The first member includes a first body and at least one first extending portion. The first extending portion extends from the first body in a first direction, and at least one sidewall of the first extending portion has a first protruding portion. The second member includes a second body and a plurality of second extending portions. The second extending portions extend from the second body in a second direction and are disposed at intervals. The first direction and the second direction are in parallel and are opposite to each other. At least one sidewall of each second extending portion has at least one second protruding portion corresponding to the first protruding portion. When the first member and the second member are assembled, the first extending portion and the second extending portions are staggered with each other. When the first member and the second member move away from each other by a predetermined distance, the first protruding portion is clamped to the second protruding portion.

According to an embodiment of the application, a shape of the first protruding portion may be a rectangle, a trapezoid or a triangle.

According to an embodiment of the application, the at least one second protruding portion may be a plurality of second protruding portions. The second protruding portions are separated from each other by a distance in the second direction, and the first protruding portion has a length in the first direction, where the length is less than or equal to the distance.

According to an embodiment of the application, the first body includes a first part and a second part. The second part is disposed at two ends of the first part, extends in the first direction, and is parallel to the first extending portion.

According to an embodiment of the application, the first member further includes a plurality of first insertion slots, formed between any neighboring two of the second part and the first extending portion. The first insertion slots are used to accommodate the plurality of second extending portions and the second protruding portion.

According to an embodiment of the application, the at least one first extending portion is a plurality of first extending portions. The first insertion slots are formed between any neighboring two of the first extending portions.

According to an embodiment of the application, each first protruding portion extends towards a corresponding one of the first insertion slots, to form a neck inlet of the first insertion slot. A width of the neck inlet is greater than or equal to a width of the second extending portion.

According to an embodiment of the application, the second member further includes a plurality of second insertion slots, formed between any neighboring two of the second extending portions. The second insertion slots are used to accommodate the at least one first extending portion and the first protruding portion.

According to an embodiment of the application, the first body, the first extending portion, the first protruding portion, the second body, the second extending portions, and the second protruding portion extend in a same plane.

According to an embodiment of the application, the cushion further includes at least one extension structure. The extension structure is configured between the first member and the second member. The extension structure includes at least one third insertion slot, at least one first clamping portion, at least one fourth insertion slot, and at least one second clamping portion. The third insertion slot is disposed to accommodate the at least one first extending portion and the first protruding portion. The first clamping portion is disposed at the third insertion slot. The fourth insertion slot is disposed at an interval from the third insertion slot, and is disposed to accommodate the plurality of second extending portions and the second protruding portion. The second clamping portion is disposed at the fourth insertion slot. When the first member, the second member, and the extension structure move away from each other by the predetermined distance, the first protruding portion is clamped to the first clamping portion, and the second protruding portion is clamped to the second clamping portion.

According to an embodiment of the application, the first member, the second member, and the extension structure extend in a same plane.

BRIEF DESCRIPTION OF THE DRAWINGS

To make the foregoing and other objectives, features, advantages, and embodiments of the application more obvious and comprehensible, the accompanying drawings are described as follows.

DETAILED DESCRIPTION OF THE EMBODIMENTS

Figure 1:
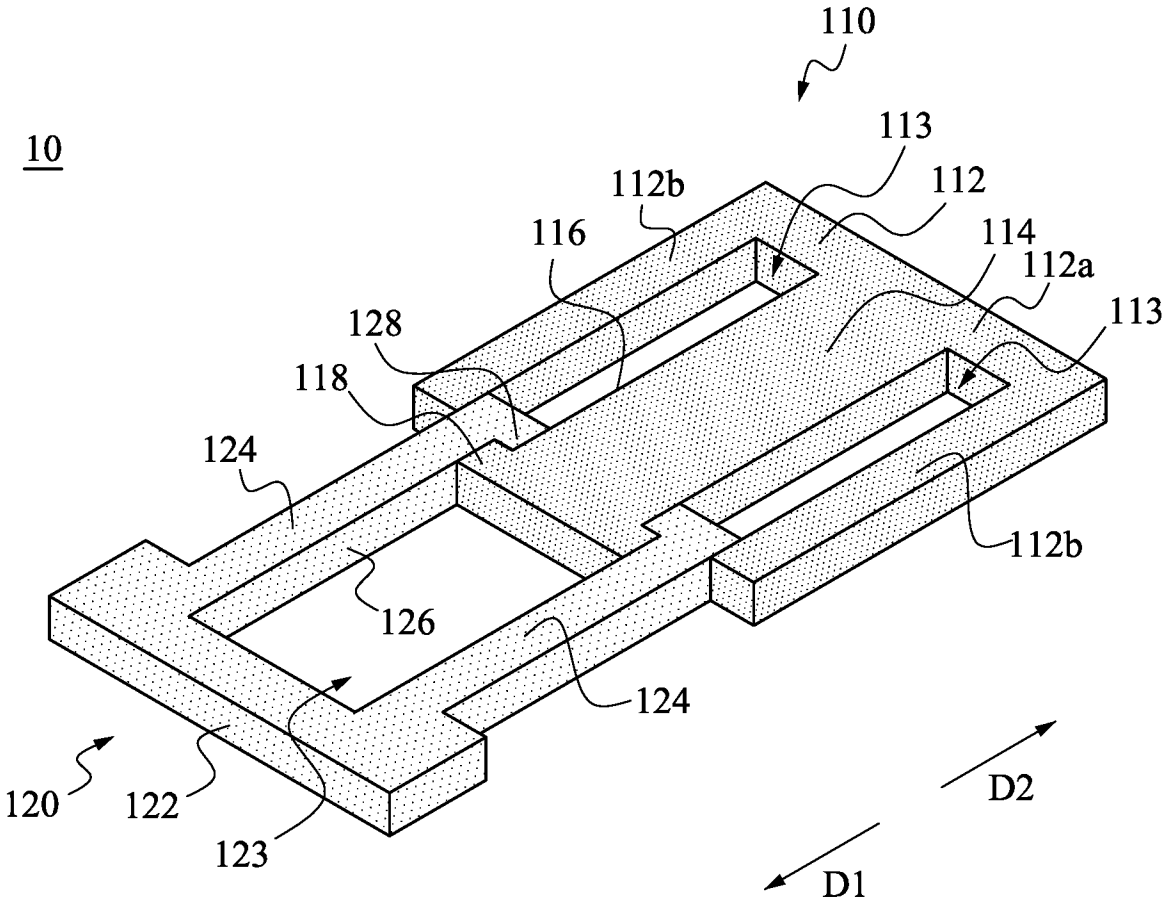
FIG. 1 is a schematic perspective view of a cushion in a stretched state according to an embodiment of the application.

To make the descriptions of the disclosed content more thorough and complete, embodiment aspects and specific embodiments of the application are described below in an illustrative manner. However, these specific embodiments are not exclusive forms of implementing or using the specific embodiments of the application. The disclosed embodiments may be beneficially combined or replaced, or another embodiment may be added to an embodiment without needing to provide further records or descriptions.

In the following descriptions, many specific details are described in detail to enable a reader to fully understand the following embodiments. However, the embodiments of the application may be practiced without these specific details. In other cases, to simplify the drawings, well-known structures and apparatuses are only schematically depicted in the drawings.

An aspect of the application provides a cushion. The cushion can reduce material usage to reduce costs. Furthermore, compared with a conventional cushion, the cushion of the application has a relatively small volume and a relatively light weight, so that larger warehousing space is saved. In addition, the cushion of the application can further enhance environmental protection awareness in answer to energy conservation and carbon emission reduction. FIG. 1 is a schematic perspective view of a cushion 10 in a stretched state according to an embodiment of the application.

Referring to FIG. 1, the cushion 10 includes a first member 110 and a second member 120. The first member 110 includes a first body 112 and at least one first extending portion 114. Specifically, the first extending portion 114 extends from the first body 112 in a first direction D1, and at least one sidewall 116 of the first extending portion 114 has a first protruding portion 118. In an embodiment, the first protruding portion 118 may be located on one sidewall 116 or two opposite sidewalls 116 of the first extending portion 114. In some embodiments, the first body 112 includes a first part 112*a* and a second part 112*b*. The first part 112*a* extends in a direction perpendicular to the first direction D1. The second part 112*b* b extends in the first direction D1. The second part 112*b* is located at two ends of the first part 112*a*. In some embodiments, a sidewall of the second part 112*b* of the first body 112 may include the first protruding portion 118.

In some embodiments, a material of the first member 110 may include a foamed plastic, a wooden board, silicone, sponge and/or rubber. For example, the material of the first member 110 may be a foamed plastic, for example, polyethylene (PE), polypropylene (PP), polyvinyl chloride (PVC), polyurethanes (PU), poly(methyl methacrylate) (PMMA), urea-formaldehyde resin (UF), ethylene vinyl acetate copolymer (EVA) or polystyrene (PS), but is not limited thereto.

In some embodiments, a shape of the first protruding portion 118 may be a rectangle, a trapezoid or a triangle, but is not limited thereto.

Still, referring to FIG. 1, the second member 120 includes a second body 122 and a plurality of second extending portions 124. The second extending portions 124 extend from the second body 122 in a second direction D2. It should be noted that the second direction D2 and the first direction D1 are in parallel and are opposite to each other. At least one sidewall 126 of each second extending portion 124 has at least one second protruding portion 128. For example, the second protruding portion 128 may be located on one sidewall 126 or two opposite sidewalls 126 of the second extending portion 124.

The first member 110 may further include a plurality of first insertion slots 113. The first insertion slots 113 are formed between any neighboring two of the second part 112*b* and the first extending portion 114, and the first insertion slots 113 are used to accommodate the second extending portions 124 and the second protruding portion 128. The second member 120 may further include a plurality of second insertion slots 123. The second insertion slots 123 are formed between two neighboring second extending portions 124. The second insertion slots 123 are used to accommodate the first extending portion 114 and the first protruding portion 118.

In some embodiments, a material of the second member 120 may include a foamed plastic, a wooden board, silicone, sponge and/or rubber. For example, the material of the second member 120 may be a foamed plastic, for example, PE, PP, PVC, PU, PMMA, UF, EVA or PS, but is not limited thereto.

In some embodiments, a shape of the second protruding portion 128 may be a rectangle, a trapezoid or a triangle, but is not limited thereto.

Referring to FIG. 1, when the first member 110 and the second member 120 are assembled, the first extending portion 114 of the first member 110 and the second extending portions 124 of the second member 120 are staggered with each other. As shown in FIG. 1, if the first member 110 and the second member 120 are assembled, when the first member 110 and the second member 120 move away from each other by a predetermined distance, the first protruding portion 118 is clamped to the second protruding portion 128. More specifically, when the first member 110 and the second member 120 displace away from each other in the first direction D1 or the second direction D2 by the predetermined distance, the first protruding portion 118 and the second protruding portion 128 are clamped to each other. In another embodiment, the first protruding portion 118 may extend in a lateral direction from a top end of the first extending portion 114, and the second protruding portion 128 may extend in a lateral direction from a top end of the second extending portion 124, so that when the first protruding portion 118 is clamped to the second protruding portion 128, the first member 110 and the second member 120 have a largest relative displacement in the first direction D1 or the second direction D2. In an embodiment in which a sidewall of the second part 112*b* of the first body 112 has the first protruding portion 118 (not shown), a sidewall, corresponding to the sidewall of the second part 112*b*, of the second extending portion 124 may also have the second protruding portion 128 to be clamped to the first protruding portion 118.

Figure 2:
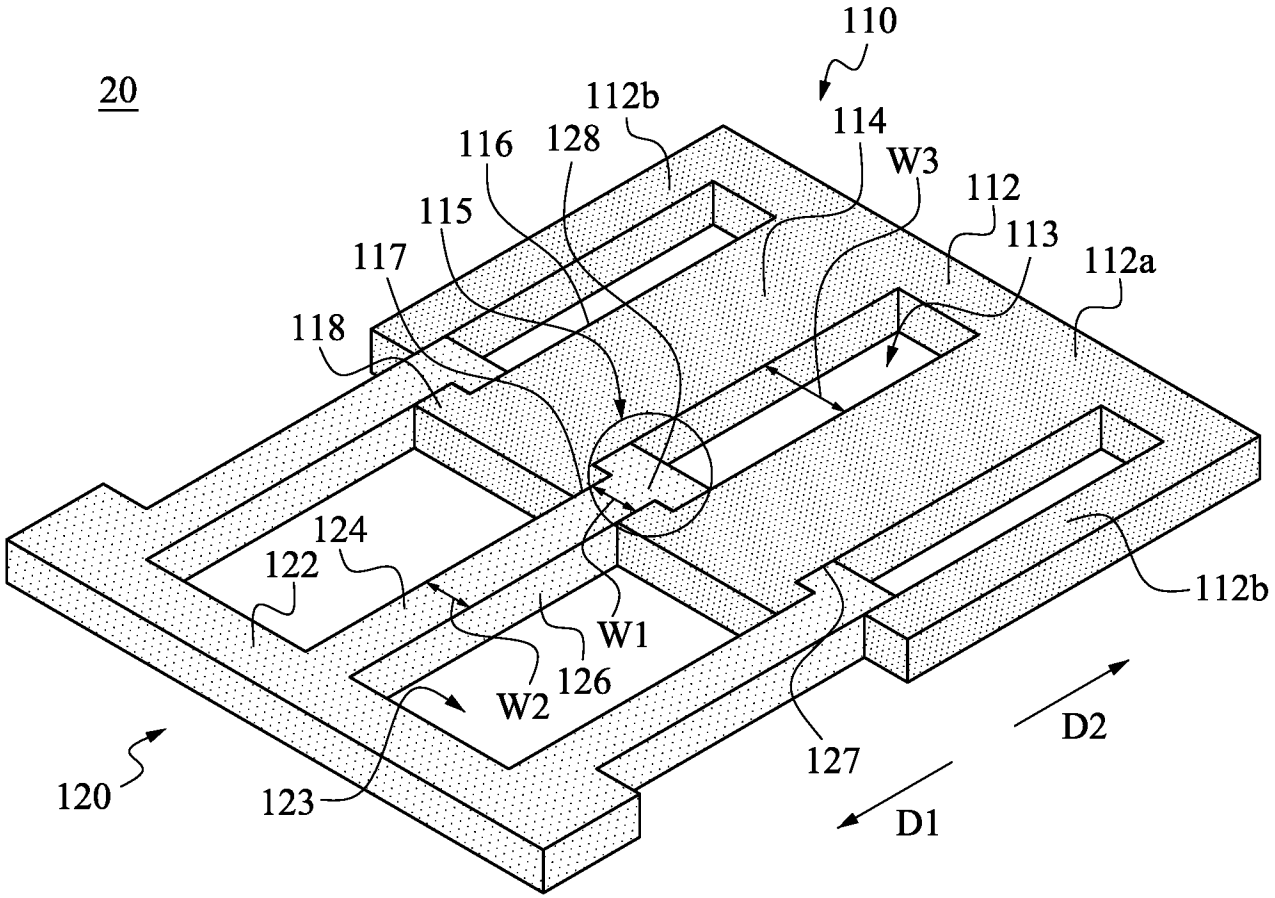
FIG. 2 is a schematic perspective view of a cushion in a stretched state according to another embodiment of the application.
Figure 3:
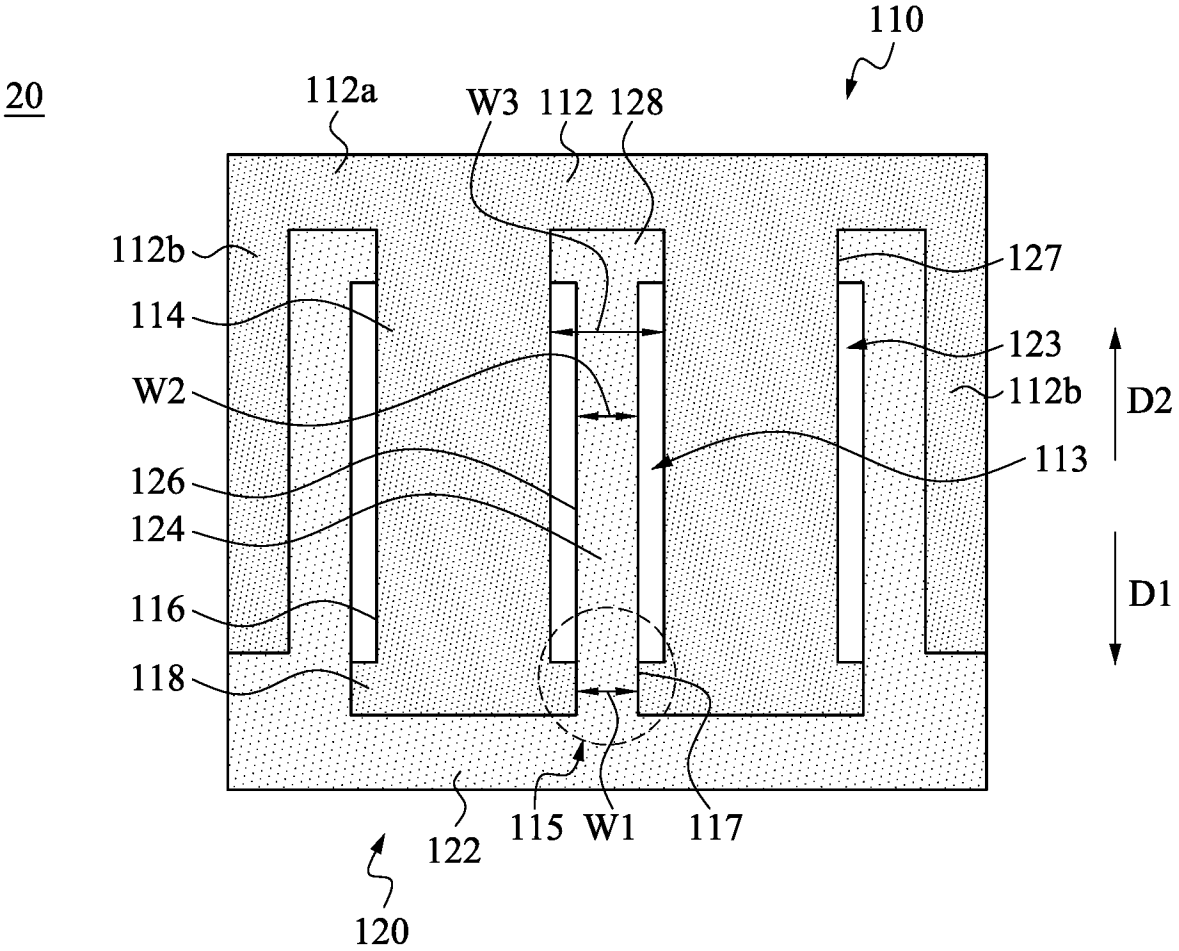
FIG. 3 is a schematic top view of a cushion according to another embodiment of the application.
Figure 4B:
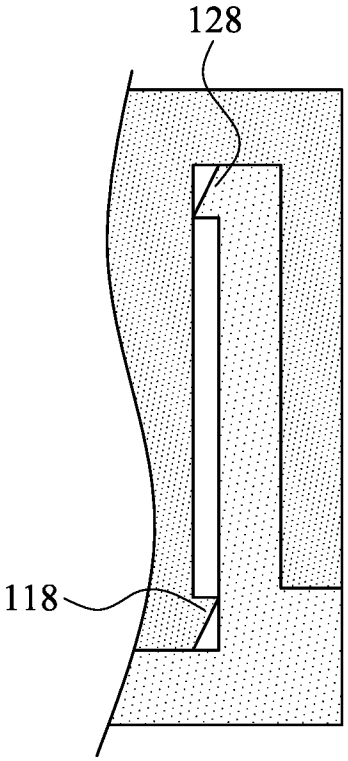
FIG. 4A to FIG. 4D are schematic partially enlarged top views of FIG. 3 according to a plurality of embodiments of the application.
Figure 4A:
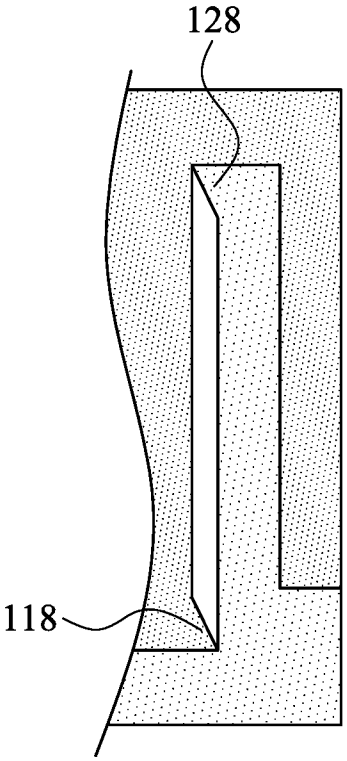
Figure 4D:
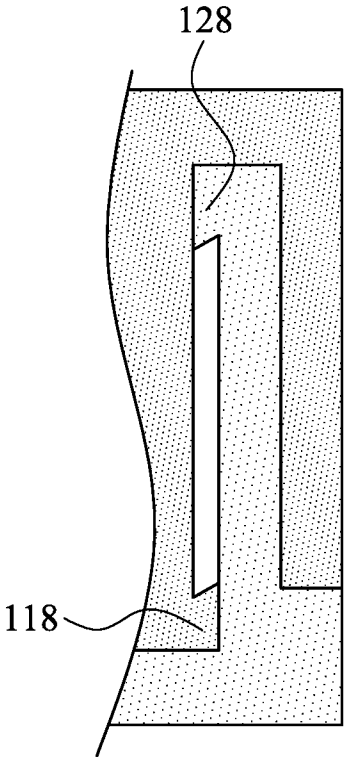
Figure 4C:
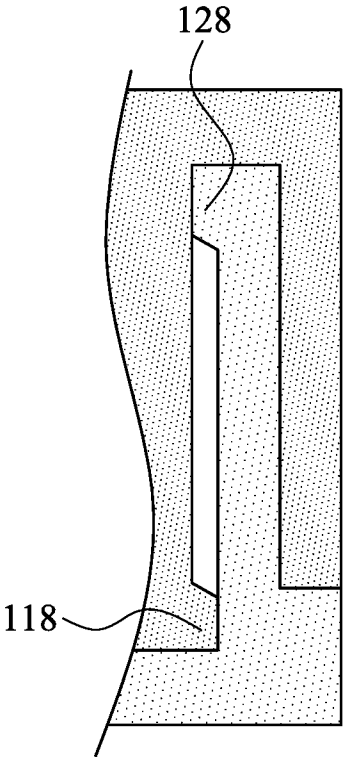

FIG. 2 is a schematic perspective view of a cushion 20 in a stretched state according to another embodiment of the application. FIG. 3 is a schematic top view of the cushion 20 according to another embodiment of the application. Referring to both FIG. 2 and FIG. 3, the at least one first extending portion 114 may be a plurality of first extending portions 114. The first insertion slots 113 may be formed between any neighboring two of the second part 112*b* and the first extending portion 114, and in addition, may be formed between any neighboring two of the first extending portions 114. That is, in an embodiment in which the first member 110 has a plurality of first extending portions 114, the first insertion slot 113 may also be formed between any neighboring two of the first extending portions 114 of the first member 110. More specifically, an opening end 115 of the first insertion slot 113 has a neck inlet 117. It may be understood that each first protruding portion 118 extends towards a corresponding one of the first insertion slots 113, to form the neck inlet 117 of the first insertion slot 113. More specifically, a width W1 of the neck inlet 117 is less than a width W3 far away from the opening end 115 of the first insertion slot 113. In an embodiment, the width W1 of the neck inlet 117 may be greater than or equal to a width W2 of the second extending portion 124.

Still, referring to FIG. 2 and FIG. 3, an opening end of the second insertion slot 123 also has a neck inlet 127. It may be understood that each second protruding portion 128 extends towards a corresponding one of the second insertion slots 123, to form the neck inlet 127 of the second insertion slot 123. The first protruding portion 118 and the second protruding portion 128 that extend respectively in a lateral direction from the sidewall 116 of the first extending portion 114 and the sidewall 126 of the second extending portion 124 are the key factors in forming the neck inlet 117 and the neck inlet 127.

In some embodiments, the first member 110 and the second member 120 extend in a same plane. In other words, the first body 112, the first extending portion 114, the first protruding portion 118, the second body 122, the second extending portions 124, and the second protruding portion 128 are all substantially located in a same plane.

FIG. 4A to FIG. 4D are schematic partially enlarged top views of FIG. 3 according to a plurality of embodiments of the application. Referring to both FIG. 4A to FIG. 4D, a shape of the first protruding portion 118 and a shape of the second protruding portion 128 may be rectangles, trapezoids or triangles, but are not limited thereto. It should be noted that when the first protruding portion 118 is clamped to the second protruding portion 128, the first protruding portion 118 and the second protruding portion 128 are tightly joined to each other.

The cushion in the embodiment of the application is not limited to the foregoing embodiments. Cushions in other variant embodiments of the application are sequentially described below. To make it easy to compare differences between the variant embodiments and simplify the descriptions, the same symbols are used to label the same members in the following variant embodiments, and mainly the differences between the variant embodiments are described while repetitive parts are not described again.

Figure 5:
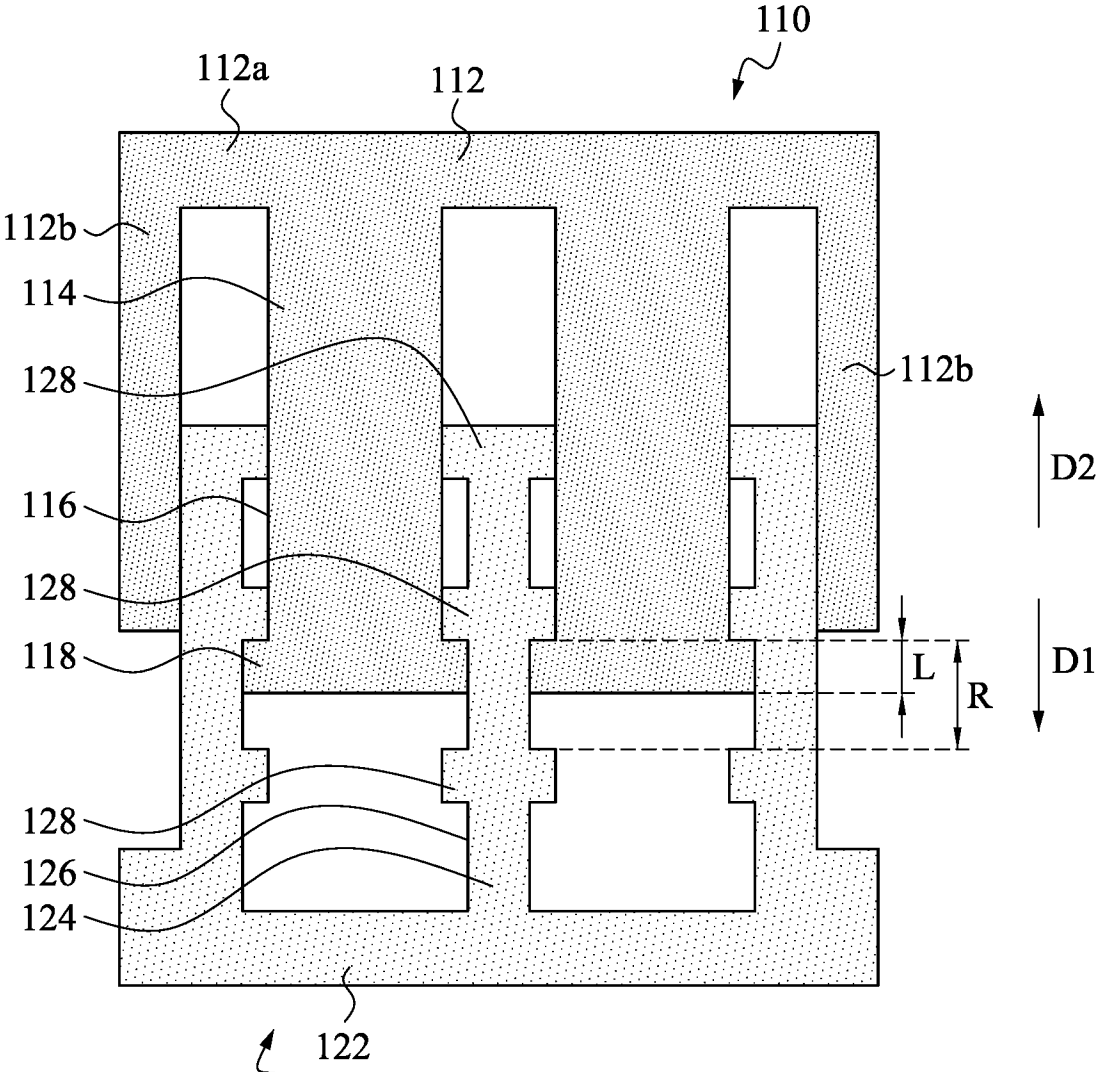
FIG. 5 is a schematic perspective view of a cushion in a stretched state according to still another embodiment of the application.

FIG. 5 is a schematic perspective view of a cushion 30 in a stretched state according to still another embodiment of the application. The cushion 30 shown in FIG. 5 includes the first member 110 and the second member 120. It should be noted that a difference between the cushion 30 shown in FIG. 5 and the cushion 20 shown in FIG. 3 lies in that the sidewall 126 of the second extending portion 124 included in the second member 120 of the cushion 30 shown in FIG. 5 has a plurality of second protruding portions 128. More specifically, the second protruding portions 128 are separated from each other by a distance R in the second direction D2, and the first protruding portion 118 has a length L in the first direction D1. In an embodiment, the length L is less than the distance R. In another embodiment, the length L is equal to the distance R. The plurality of second protruding portions 128 are added on the sidewall 126 of the second extending portion 124. Therefore, a user may adjust the size of the cushion 30 more conveniently based on the size of a carried object.

Figure 6:
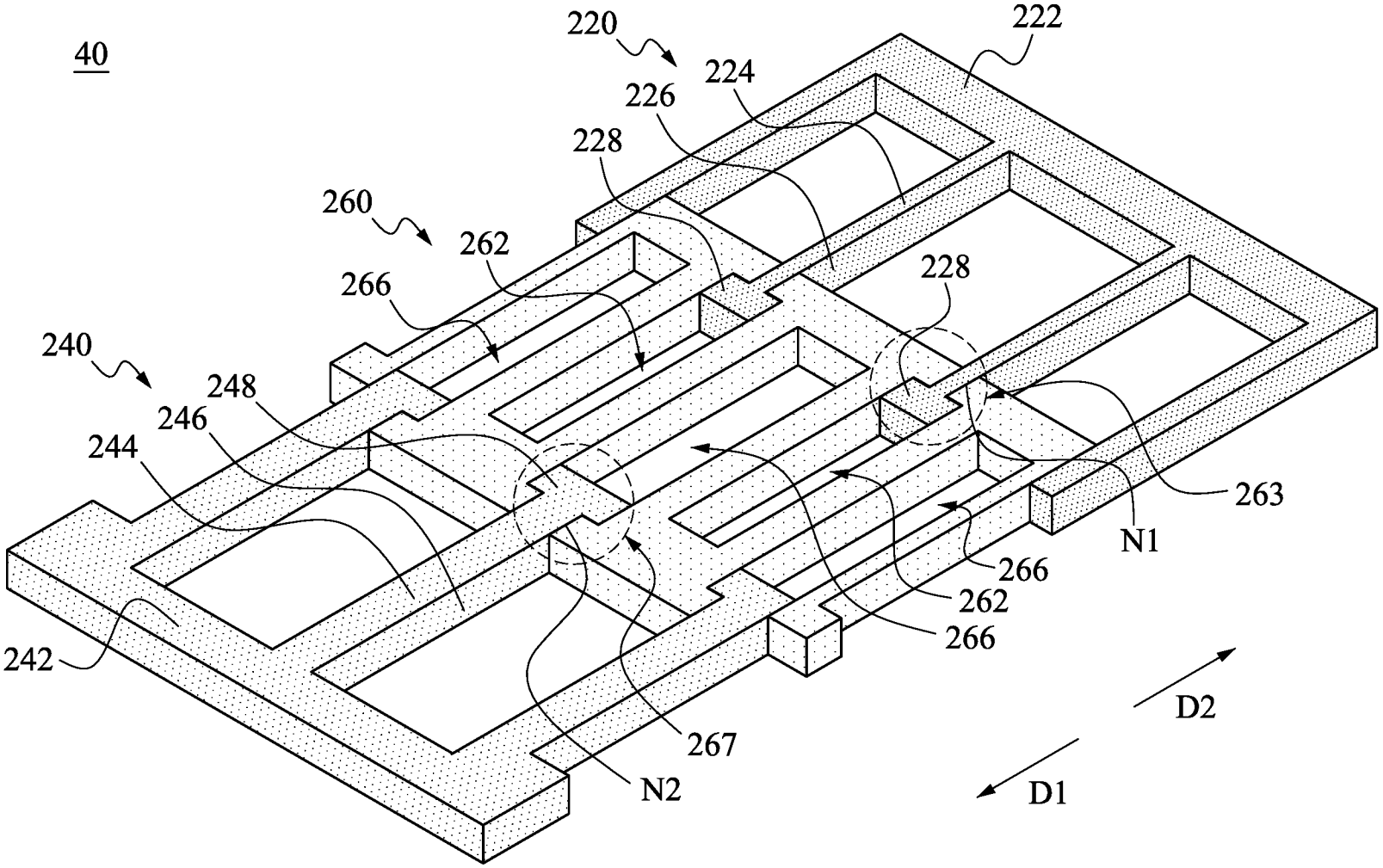
FIG. 6 is a schematic perspective view of a cushion in a stretched state according to another embodiment of the application.
Figure 7:
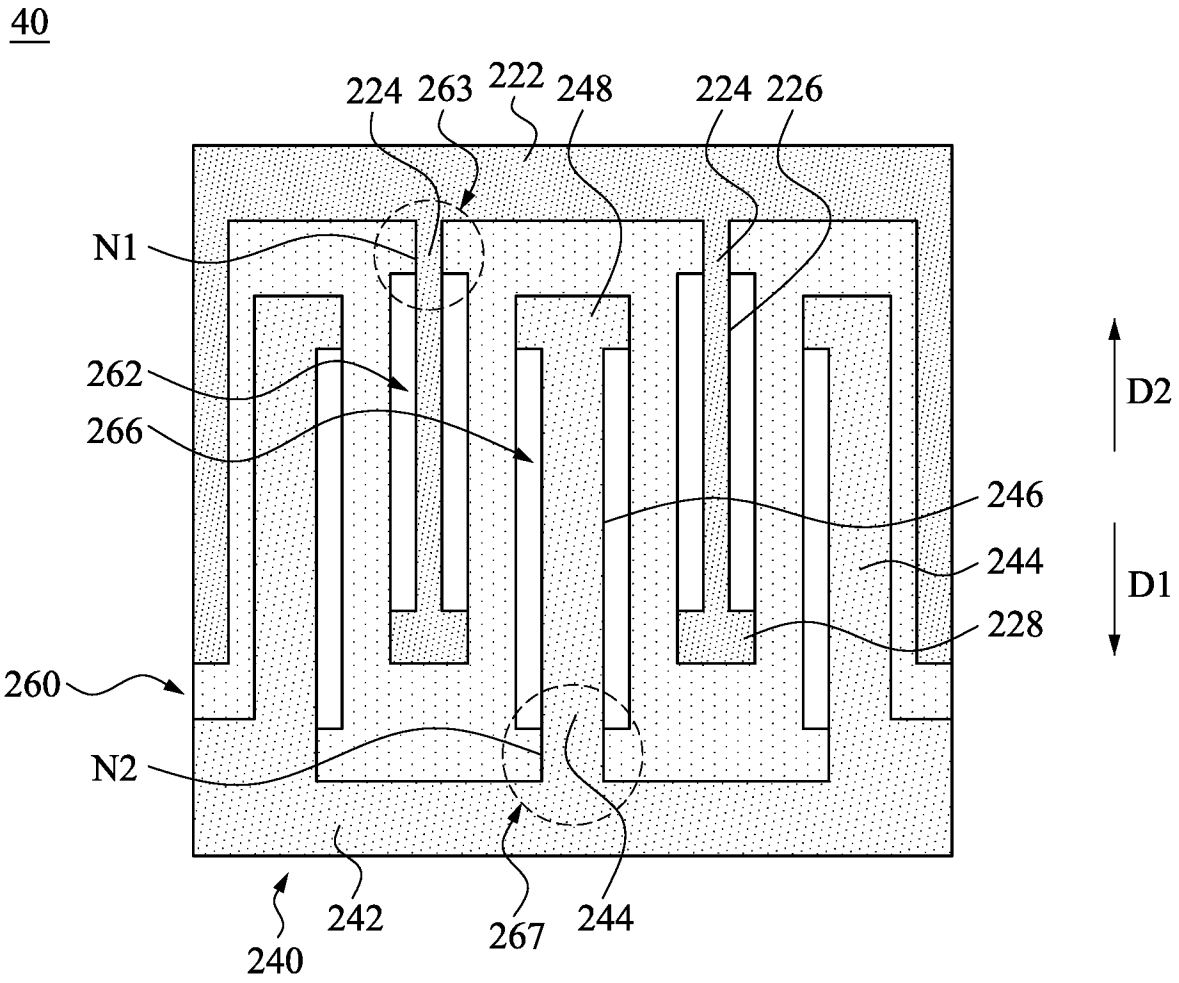
FIG. 7 is a schematic top view of a cushion according to another embodiment of the application.

FIG. 6 is a schematic perspective view of a cushion 40 in a stretched state according to another embodiment of the application. FIG. 7 is a schematic top view of the cushion 40 according to another embodiment of the application. Referring to both FIG. 6 and FIG. 7, the cushion 40 includes a first member 220, a second member 240, and at least one extension structure 260. It should be noted that a difference between the cushion 40 shown in FIG. 6 and FIG. 7 and the cushion 20 shown in FIG. 2 and FIG. 3 lies in that the cushion 40 shown in FIG. 6 and FIG. 7 further includes the at least one extension structure 260.

The first member 220 includes a first body 222 and at least one first extending portion 224. The first extending portion 224 extends from the first body 222 in the first direction D1, and at least one sidewall 226 of each first extending portion 224 has a first protruding portion 228.

In some embodiments, the materials of the first member 220, the second member 240, and the extension structure 260 may include a foamed plastic, a wooden board, silicone, sponge and/or rubber. For example, the foamed plastic may be PE, PP, PVC, PU, PMMA, UF, EVA or PS, but is not limited thereto.

In another embodiment, the at least one first protruding portion 228 may be a plurality of first protruding portions 228. The plurality of first protruding portions 228 are added on the sidewall 226 of the first extending portion 224. Therefore, a user may adjust the size of the cushion 40 more conveniently based on the size of a carried object. In some embodiments, shapes of the first protruding portions 228 may be rectangles, trapezoids or triangles. Specific structural features of the first member 220 may be, for example, similar to specific structural features of the first member 110, and details are not described herein again.

Still, referring to FIG. 6 and FIG. 7, the second member 240 includes a second body 242 and a plurality of second extending portions 244. The second extending portions 244 extend from the second body 242 in the second direction D2, and the sidewall 246 of each second extending portion 244 has at least one second protruding portion 248. It should be noted that the first direction D1 and the second direction D2 are in parallel and are opposite to each other.

In another embodiment, the at least one second protruding portion 248 may be a plurality of second protruding portions 248. The plurality of second protruding portions 248 are added on the sidewall 246 of the second extending portion 244. Therefore, a user may adjust the size of the cushion 40 more conveniently based on the size of a carried object. In some embodiments, shapes of the second protruding portions 248 may be a rectangle, a trapezoid or a triangle. Specific structural features of the second member 240 may be, for example, similar to specific structural features of the second member 120, and details are not described herein again.

Referring to FIG. 6 and FIG. 7, when the first member 220, the second member 240, and the extension structure 260 are assembled, the extension structure 260 is configured between the first member 220 and the second member 240. Specifically, the extension structure 260 includes at least one third insertion slot 262, at least one first clamping portion N1, at least one fourth insertion slot 266, and at least one second clamping portion N2. The third insertion slot 262 is disposed to accommodate the first extending portion 224 and the first protruding portion 228. The first clamping portion N1 is disposed at an inlet 263 of the third insertion slot 262. The fourth insertion slot 266 is disposed at an interval from the third insertion slot 262, and the fourth insertion slot 266 is disposed to accommodate the second extending portions 244 and the second protruding portions 248. The second clamping portion N2 is disposed at an inlet 267 of the fourth insertion slot 266.

As shown in FIG. 6, when the first member 220, the second member 240, and the extension structure 260 move away from each other by a predetermined distance, the first protruding portion 228 is clamped to the first clamping portion N1, and the second protruding portion 248 is clamped to the second clamping portion N2. More specifically, when the first member 220 and the extension structure 260 displace away from each other in the first direction D1 or the second direction D2 by the predetermined distance, the first protruding portion 228 is clamped to the first clamping portion N1. Similarly, as shown in FIG. 6, when the second member 240 and the extension structure 260 displace away from each other in the first direction D1 or the second direction D2 by the predetermined distance, the second protruding portion 248 is clamped to the second clamping portion N2.

In some embodiments, the first member 220, the second member 240, and the extension structure 260 all extend in a same plane. In other words, the first body 222, the first extending portion 224, the first protruding portion 228, the second body 242, the second extending portions 244, the second protruding portion 248, and the extension structure 260 are all substantially located in a same plane.

Compared with a conventional cushion, the cushion of the application may reduce material usage by approximately 40% to 60%, and may reduce an overall volume and an overall weight by approximately 40% to 60%. It may be understood that because the material usage is reduced, the costs may be reduced by approximately 40%. In addition, the cushion of the application may further reduce the original warehousing space by 40% to 60%.

Although the application has been disclosed above by using the embodiments, the embodiments are not used to limit the application. Any person skilled in the art may make various variations and modifications without departing from the spirit and scope of the application. Therefore, the protection scope of the application is defined by the appended claims.

What is claimed is:

1. A cushion, comprising:

a first member, comprising a first body and at least one first extending portion, wherein the at least one first extending portion extends from the first body in a first direction, and at least one sidewall of the at least one first extending portion has a first protruding portion; and a second member, comprising a second body and a plurality of second extending portions, wherein the second extending portions extend from the second body in a second direction and are disposed at intervals, the second direction and the first direction are in parallel and are opposite to each other, at least one sidewall of each second extending portion has at least one second protruding portion corresponding to the first protruding portion, wherein when the at least one second protruding portion is against the first body and the first protruding portion is against the second body, the at least one first extending portion is located between the second extending portions; and when the first member moves in the second direction and the second member moves in the first direction, the first protruding portion is adjacent to the at least one second protruding portion.

2. The cushion according to claim 1, wherein a shape of the first protruding portion is one of a rectangle, a trapezoid and a triangle.

3. The cushion according to claim 1, wherein the at least one second protruding portion is a plurality of second protruding portions, the second protruding portions are separated from each other by a separated distance in the second direction, the first protruding portion has a length in the first direction, and the length is less than or equal to the separated distance.

4. The cushion according to claim 1, wherein the first body comprises a first part and a second part, and the second part is disposed at two ends of the first part, the second part extends from the first part in the first direction, and is parallel to the at least one first extending portion.

5. The cushion according to claim 4, wherein the first member further comprises a plurality of first insertion slots, formed between any neighboring two of the second part and the at least one first extending portion, and the first insertion slots are used to accommodate the second extending portions and the second protruding portion.

6. The cushion according to claim 5, wherein the at least one first extending portion is a plurality of first extending portions, and the first insertion slots are formed between any neighboring two of the first extending portions.

7. The cushion according to claim 5, wherein the first protruding portion extends towards a corresponding one of the first insertion slots, to form a neck inlet of the first insertion slot, and a width of the neck inlet is greater than or equal to a width of the second extending portions.

8. The cushion according to claim 1, wherein the second member further comprises a plurality of second insertion slots, formed between any neighboring two of the second extending portions, and the second insertion slots are used to accommodate the at least one first extending portion and the first protruding portion.

9. The cushion according to claim 1, wherein the first body, the at least one first extending portion, the first protruding portion, the second body, the second extending portions, and the at least one second protruding portion extend in a same plane.

10. The cushion according to claim 1, further comprising:

at least one extension structure, configured between the first member and the second member, and the at least one extension structure comprising:

at least one third insertion slot, disposed to accommodate the at least one first extending portion and the first protruding portion;

at least one first clamping portion, disposed at the at least one third insertion slot;

at least one fourth insertion slot, disposed at an interval from the at least one third insertion slot, and disposed to accommodate the second extending portions and the at least one second protruding portion; and at least one second clamping portion, disposed at the at least one fourth insertion slot, wherein when the first member, the second member, and the at least one extension structure move away from each other by the predetermined distance, the first protruding portion is clamped to the at least one first clamping portion, and the at least one second protruding portion is clamped to the at least one second clamping portion.

11. The cushion according to claim 10, wherein the first member, the second member, and the at least one extension structure extend in a same plane.

* * * * *